US006679603B2

(12) United States Patent
Wexler et al.

(10) Patent No.: US 6,679,603 B2
(45) Date of Patent: Jan. 20, 2004

(54) INK JET PRINTING METHOD

(75) Inventors: Allan Wexler, Pittsford, NY (US); James A. Reczek, Rochester, NY (US); Shiying Zheng, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/184,672

(22) Filed: Jun. 18, 2002

(65) Prior Publication Data

US 2003/0231236 A1 Dec. 18, 2003

(51) Int. Cl.[7] ..... B41J 2/01
(52) U.S. Cl. ..... 347/105; 347/101; 428/195
(58) Field of Search ..... 347/101, 105, 347/102, 1, 96, 100, 106; 428/195, 98, 178, 103, 187, 189, 143, 364, 153; 346/135.1

(56) References Cited

U.S. PATENT DOCUMENTS 5,621,448 A * 4/1997 Oelbrandt et al. ..... 347/102
5,764,263 A * 6/1998 Lin ..... 347/101
5,935,688 A 8/1999 Bergthaller et al.
5,985,514 A * 11/1999 Zheng et al. ..... 430/270.1
6,465,165 B2 * 10/2002 Landry-Coltrain et al. . 430/523

* cited by examiner

*Primary Examiner*—Stephen D. Meier
*Assistant Examiner*—Manish Shah
(74) *Attorney, Agent, or Firm*—Harold E. Cole; Chris P. Konkol

(57) ABSTRACT

An ink jet printing method, including the steps of: A) providing an ink jet printer that is responsive to digital data signals; B) loading the printer with ink jet recording elements with a support having thereon an image-receiving layer of a polymer having a given contact angle; C) loading the printer with an ink jet ink composition; D) printing on the image-receiving layer using the ink jet ink in response to the digital data signals to form an imaged recording element; and E) heating the imaged recording element sufficiently to cause the layer of polymer to increase the contact angle at least about 15 degrees.

14 Claims, No Drawings

INK JET PRINTING METHOD

FIELD OF THE INVENTION

This invention relates to an ink jet printing method using a recording element that has better durability after printing.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

The image-receiving layer may typically be comprised of a hydrophilic colloid to absorb fluids from the printing ink. However, such a layer can be easily destroyed or damaged by contact with water or stained by common items such as beverages. In order to enhance the durability of a printed image, the layer can be crosslinked or laminated. Lamination is time consuming and expensive, and crosslinking does not significantly reduce the hydrophilicity or stain propensity of the layer.

U.S. Pat. No. 5,985,514 relates to an imaging member containing a heat-sensitive thiosulfate polymer containing a heat-activatable thiosulfate group. Upon application of heat, the polymer is crosslinked and rendered more hydrophobic. However, there is no disclosure in this patent of using the element for ink jet printing.

U.S. Pat. No. 5,935,688 relates to an ink jet recording material wherein the image-receiving layer contains a water soluble inorganic thiosulfate or organic thiosulfate. However, there is no disclosure in this patent of any heat treatment of the imaged layer.

It is an object of this invention to provide an ink jet printing method that produces an element that provides high quality ink jet images which has durability against water and stains.

SUMMARY OF THE INVENTION

This and other objects are achieved in accordance with the invention that comprises an ink jet printing method, comprising the steps of:

A) providing an ink jet printer that is responsive to digital data signals;

B) loading the printer with ink jet recording elements comprising a support having thereon an image-receiving layer comprising a polymer having a given contact angle;

C) loading the printer with an ink jet ink composition;

D) printing on the image-receiving layer using the ink jet ink in response to the digital data signals to form an imaged recording element; and E) heating the imaged recording element sufficiently to cause the layer of polymer to increase the contact angle at least about 15 degrees.

By use of the process of the invention, an ink jet recording element is obtained that provides high quality ink jet images which has improved durability against water and stains.

DETAILED DESCRIPTION OF THE INVENTION

In a preferred embodiment of the invention, the polymer is water-soluble or water-dispersible. In another preferred embodiment, the water-soluble or water-dispersible polymer has a thiosulfate group pendant directly or indirectly from the polymer backbone. In another preferred embodiment, the water-soluble or water-dispersible polymer can be represented by the following structure:

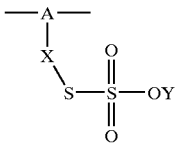

wherein A represents a polymeric backbone, X is a divalent linking group, and Y is hydrogen or a cation. Organic thiosulfates are sometimes referred to as Bunte salts.

In another preferred embodiment of the invention, X in the above formula is an alkylene group, an arylene group, an arylenealkylene group, or —$(COO)_n(Z)_m$ wherein n is 0 or 1, m is 0 or 1, and Z is an alkylene group, an arylene group, or an arylenealkylene group and Y is hydrogen, ammonium ion, alkylamine ion or a metal ion. In another preferred embodiment, X is an alkylene group of 1 to 3 carbon atoms, an arylene group of 6 carbon atoms in the aromatic ring, an arylenealkylene group of 7 or 8 carbon atoms in the chain, or —COOZ wherein Z is methylene, ethylene or phenylene, and Y is hydrogen, sodium or potassium. In yet another preferred embodiment, X is methylene, ethylene, phenylene or —COO—.

In another preferred embodiment, the polymeric backbone can be a vinyl polymer, polyether, polyester, polyimide, polyamide or polyurethane.

The water-soluble or water-dispersible polymer useful in this invention has a molecular weight of at least about 1000, and preferably of at least about 5000. The polymer can be a vinyl homopolymer or copolymer prepared from one or more ethylenically unsaturated polymerizable monomers that are reacted together using known polymerization techniques and reactants. Alternatively, it can be an addition homopolymer or copolymer (such as a polyether) prepared from one or more heterocyclic monomers that are reacted together using known polymerization techniques and reactants. Additionally, it can be a condensation type polymer (such as a polyester, polyimide, polyamide or polyurethane) prepared using known polymerization techniques and reactants.

When the thiosulfate group is pendant to the backbone, it is preferably part of an ethylenically unsaturated polymerizable monomer that can be polymerized using conventional techniques to form vinyl homopolymers of the thiosulfate-containing recurring units, or vinyl copolymers when copolymerized with one or more additional ethylenically unsaturated polymerizable monomers. The thiosulfate-containing recurring units generally comprise at least about 10 mol % of all recurring units in the polymer, preferably from about 15 to 100 mol % of all recurring units, and more preferably, from about 15 to about 50 mol % of all recurring units. A polymer can include more than one type of repeating unit containing a thiosulfate group as described herein.

Polymers having the above-described thiosulfate group are believed to crosslink and to switch from hydrophilic thiosulfate to hydrophobic disulfide with heating.

Examples of polymers that may be used in the invention include:

Polymer 1 poly(vinyl benzyl thiosulfate sodium salt-co-methyl methacrylate) with a 80:20 monomer ratio, and Polymer 2 poly(vinyl benzyl thiosulfate sodium salt-co-methyl methacrylate-co-butyl acrylate) with a 70:20:10 monomer ratio.

Other examples are disclosed in U.S. Pat. No. 5,985,514, the disclosure of which is hereby incorporated by reference.

In order to render an ink jet print more durable, the initially highly wettable ink-receptive print surface needs to be rendered water and stain repellant after printing. It is well known that water contact angle is a measure of the degree of repellency of a surface, and the greater the contact angle the greater the repellency. See "Chemistry and Physics of Interfaces," A. M. Schwartz, American Chemical Society, 1971. In the art, if the measured contact angle is greater than about 90°, the surface is considered hydrophobic, but lesser contact angle values, and specifically values greater than about 30°, confer adequate repellency and protection. Conversely, a contact angle of less than about 15° indicates a highly wettable and ink-receptive surface, but one which is also subject to damage by water and stains and is therefore not durable.

As described above, the imaged recording element is heated sufficiently to cause the layer of polymer to increase the contact angle at least about 15 degrees. In a preferred embodiment of the invention, the imaged recording element is heated sufficiently to cause the layer of polymer to increase the contact angle at least about 30 degrees.

Various heating methods can be used. There can be used, for example, belt-fusing as described in U.S. Pat. Nos. 5,890,032 and 5,256,507, radiant heating, forced air, infrared heating, etc. In general, most polymers will undergo the transition from wettable to repellant at temperatures of at least about 100° C.

The support used in the invention may be porous such as paper or nonporous such as resin-coated paper; synthetic paper, such as Teslin® or Tyvek®; an impregnated paper such as Duraform®; cellulose acetate or polyester films. The surface of the substrate may be treated in order to improve the adhesion of the image-receiving layer to the support. For example, the surface may be corona discharge treated prior to applying the image-receiving layer to the support. Alternatively, a base layer or subbing layer, such as a layer formed from a halogenated phenol or a partially hydrolyzed vinyl chloride-vinyl acetate copolymer, can be applied to the surface of the support.

Other additives may also be included in the image-recording layer such as pH-modifiers, rheology modifiers, surfactants, UV-absorbers, biocides, lubricants, mordants, optical brighteners, inorganic or organic particles, a polymeric binder, etc.

The ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 μm, preferably from about 5 to about 40 μm. Thicker layers may evidence cracking which can be eliminated with a thermal annealing of the layer at temperatures below the thiosulfate decomposition temperature.

Ink jet inks used to image the recording elements employed in the invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

Preparation of Element 1

A 16.4 wt. % aqueous solution of Polymer 1 was coated onto a corona discharge-treated resin-coated paper, using a wire wound rod calibrated to give a wet laydown of 80 μm and air dried to give a transparent coating. The coating was then heat treated by belt fusing at 46 cm/min at the temperatures of the heated roller around which the belt is transported as shown in Table 1.

Preparation of Element 2

This element was prepared the same as Element 1 except that a 10 wt. % solution of Polymer 2 was used.

Water Repellency

The water repellency of the layer was determined by measuring the water contact angle of the layer after a droplet residence time of 25 minutes. The higher the contact angle the more repellent the layer. A contact angle greater than about 30° is considered to be sufficiently water repellent to render the print durable.

Water sessile drop contact angles in degrees was measured with an FTA 200 Dynamic Contact Angle System from Camtel, Ltd. The following results were obtained:

TABLE 1

| Element | Roller Temperature | Contact Angle (°) |
|---|---|---|
| Element 1 | Ambient | 9.7 |
| Element 1 | 121° C. | 13.0 |
| Element 1 | 149° C. | 9.5 |
| Element 1 | 177° C. | 54.3 |
| Element 2 | Ambient | 8.6 |
| Element 2 | 121° C. | 7.6 |
| Element 2 | 149° C. | 39.8 |
| Element 2 | 177° C. | 50.8 |

The above results show that when Element 1 is heated sufficiently by the heated roller (177° C.), the water contact angle increases from 9.7° to 54.3°. The above results also show that when Element 2 is heated sufficiently by the heated roller (149° C.), the water contact angle increases from 8.6° to 39.8°.

Example 2

Elements 1 and 2 above were annealed at 121° C. by passing through a belt fuser at 46 cm/min to give Control Elements 1 and 2, respectively. An image consisting of cyan and magenta patches was then printed on the elements using a Hewlett-Packard PhotoSmart® photo printer with ink cartridges C3844A and C3844B. Samples of Control Elements 1 and 2 were then heat treated by belt fusing at 46 cm/min at 177° C. as described in Example 1 to give Elements 3 and 4, respectively.

The above imaged elements were then subjected to a water resistance test in which a drop of liquid was placed on non-imaged and imaged areas. After 30 minutes, the water was blotted off. The above imaged elements were also subjected to stain resistance tests in which drops of mustard, coffee, cola and punch were placed on non-imaged areas. After 30 minutes, the drops were blotted off. The results were evaluated as follows:

3=No observable effect (no staining, deglossing or loss of color density)

2=Observable effect (slight staining, slight deglossing or slight loss of color density)

1 =Destructive effect (no remaining color density, significant residual stain or catastrophic loss of gloss).

The following results were obtained:

TABLE 2

| Test | Control Element 1 | Control Element 2 | Element 3 | Element 4 |
|---|---|---|---|---|
| Water on non-imaged area | 1 | 1 | 3 | 3 |
| Water on imaged area | 1 | 1 | 2 | 2 |
| Mustard | 1 | 1 | 3 | 3 |
| Coffee | 1 | 1 | 3 | 3 |
| Punch | 1 | 1 | 3 | 3 |
| Cola | 1 | 1 | 3 | 3 |

The above results show that the elements of the invention were water and stain resistant upon heat treatment.

This invention has been described with particular reference to preferred embodiments thereof, but it will be understood that modifications can be made within the spirit and scope of the invention.

What is claimed is:

1. An ink jet printing method, comprising the steps of:

A) providing an ink jet printer that is responsive to digital data signals;

B) loading said printer with ink jet recording elements comprising a support having thereon an image-receiving layer comprising a water-soluble or water-dispersible polymer having a thiosulfate group pendant directly or indirectly from the polymer's backbone and having a given contact angle;

C) loading said printer with an ink jet ink composition;

D) printing on said image-receiving layer using said ink jet ink in response to said digital data signals to form an imaged recording element; and E) heating said imaged recording element sufficiently to cause said layer of polymer to increase said contact angle at least about 15 degrees.

2. The method of claim 1 wherein said water-soluble or water-dispersible polymer can be represented by the following structure:

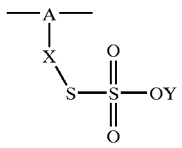

wherein A represents a polymeric backbone, X is a divalent linking group, and Y is hydrogen or a cation.

3. The method of claim 1 wherein said heat is applied using a heated belt or rollers.

4. The method of claim 2 wherein X is an alkylene group, an arylene group, an arylenealkylene group, or —$(COO)_n$ $(Z)_m$ wherein n is 0 or 1, m is 0 or 1, and Z is an alkylene group, an arylene group, or an arylenealkylene group and Y is hydrogen, ammonium ion, alkylamine ion or a metal ion.

5. The method of claim 2 wherein X is an alkylene group of 1 to 3 carbon atoms, an arylene group of 6 carbon atoms in the aromatic ring, an arylenealkylene group of 7 or 8 carbon atoms in the chain, or —COOZ wherein Z is methylene, ethylene or phenylene, and Y is hydrogen, sodium or potassium.

6. The method of claim 2 wherein X is methylene, ethylene, phenylene or —COO—.

7. The method of claim 1 wherein said water-soluble or water-dispersible polymer is a vinyl polymer, polyether, polyester, polyimide, polyamide or polyurethane.

8. The method of claim 1 wherein said water-soluble or water-dispersible polymer is derived from at least about 10 mol % of a monomer comprising thiosulfate groups.

9. The method of claim 1 wherein said water-soluble or water-dispersible polymer is a copolymer derived from one or more different ethylenically unsaturated polymerizable monomers, at least one of said monomers comprising said thiosulfate group.

10. The method of claim 1 wherein said water-soluble or water-dispersible polymer is derived from acrylate, acrylamide or styrene monomers.

11. The method of claim 1 wherein said image-receiving layer contains inorganic or organic particles.

12. The method of claim 1 wherein said image-receiving layer contains a polymeric binder.

13. The method of claim 1 wherein said recording element contains a base layer between said support and said image-receiving layer.

14. The method of claim 1 wherein said contact angle is increased after heating at least about 30 degrees.

* * * * *